US012679586B2

(12) United States Patent
Scheuber et al.

(10) Patent No.: US 12,679,586 B2
(45) Date of Patent: Jul. 14, 2026

(54) REFILL STATION FOR A DISPENSER CAN WITH A REFILL LOCK FOR AN IMPERMISSIBLE ACTIVE SUBSTANCE

(71) Applicant: WÜRTH INTERNATIONAL AG, Chur (CH)

(72) Inventors: Michael Scheuber, Langenbrettach (DE); Herbert Reuther, Krautheim (DE)

(73) Assignee: WÜRTH INTERNATIONAL AG, Chur (CH)

( * ) Notice: Subject to any disclaimer, the term of this patent is extended or adjusted under 35 U.S.C. 154(b) by 174 days.

(21) Appl. No.: 18/566,465

(22) PCT Filed: May 4, 2022

(86) PCT No.: PCT/EP2022/061901
§ 371 (c)(1),
(2) Date: Dec. 1, 2023

(87) PCT Pub. No.: WO2022/253509
PCT Pub. Date: Dec. 8, 2022

(65) Prior Publication Data

US 2024/0246710 A1 Jul. 25, 2024

(30) Foreign Application Priority Data

Jun. 2, 2021 (DE) ..... 10 2021 114 334.9

(51) Int. Cl.
*B65B 57/14* (2006.01)
*B65B 3/28* (2006.01)
(Continued)

(52) U.S. Cl.
CPC ..... *B65B 57/145* (2013.01); *B65B 3/28* (2013.01); *B65B 31/003* (2013.01); *B65B 57/06* (2013.01); *B65D 83/42* (2013.01)

(58) Field of Classification Search
CPC ..... B65B 3/28; B65B 31/003; B65B 57/06; B65B 57/145; B65D 83/42
See application file for complete search history.

(56) References Cited

U.S. PATENT DOCUMENTS 5,975,165 A * 11/1999 Motosugi ..... B67D 7/421 141/94
7,152,781 B2 * 12/2006 O'Dougherty ..... G05B 19/0425 235/375

(Continued)

FOREIGN PATENT DOCUMENTS

DE 10 2009 038 471 A1 5/2011
JP H06100096 A 4/1994

(Continued)

OTHER PUBLICATIONS

German Search Report of DE 10 2021 114 334.9, Dec. 17, 2021, 7 pages.

(Continued)

*Primary Examiner* — Nicolas A Arnett
(74) *Attorney, Agent, or Firm* — Womble Bond Dickinson (US) LLP

(57) ABSTRACT

Refill station comprising a receiving device for receiving a dispenser can which is to be refilled with an active substance, a capturing unit for capturing if an active substance which is to be refilled into the dispenser can which is received at the receiving device fulfills at least one predetermined permissibility criterion, and a control unit which is configured for permitting a refill of the dispenser can with the active substance via the receiving device only when the active substance which is captured at the capturing unit fulfills the at least one predetermined permissibility criterion.

14 Claims, 4 Drawing Sheets

(51) Int. Cl.

| | |
|---|---|
| ***B65B 31/00*** | (2006.01) |
| ***B65B 57/06*** | (2006.01) |
| ***B65D 83/42*** | (2006.01) |

(56) References Cited

U.S. PATENT DOCUMENTS

| | | | | |
|---|---|---|---|---|
| 8,844,584 | B1 * | 9/2014 | Haley | B65B 3/26 141/3 |
| 9,580,294 | B2 * | 2/2017 | Lewis | B67D 7/344 |
| 9,637,258 | B1 * | 5/2017 | Haley | B65B 3/17 |
| 9,823,665 | B2 * | 11/2017 | Finnell | B67D 7/344 |
| 10,407,296 | B2 * | 9/2019 | Bjornebo | B67D 7/342 |
| 2015/0274375 | A1 * | 10/2015 | Kling | A47K 5/1209 222/103 |
| 2015/0375984 | A1 * | 12/2015 | Arcand | G07F 13/065 141/94 |
| 2017/0022045 | A1 * | 1/2017 | Ray | G07F 13/025 |
| 2017/0314733 | A1 * | 11/2017 | Tilhof | F17C 13/02 |
| 2019/0352172 | A1 * | 11/2019 | Bjornebo | G01N 21/85 |

FOREIGN PATENT DOCUMENTS

| | | | |
|---|---|---|---|
| JP | H10296204 | A | 11/1998 |
| JP | 2005096874 | A | 4/2005 |
| JP | 2008094496 | A | 4/2008 |
| JP | 2013522586 | A | 6/2013 |
| JP | 2017534035 | A | 11/2017 |
| WO | WO 2018/071539 | A1 | 4/2018 |

OTHER PUBLICATIONS

International Search Report and Written Opinion of PCT/EP2022/061901, Sep. 9, 2022, 13 pages.

Japanese Office action for Application No. 2023-565538, dated Oct. 1, 2024, 2 pages.

Japanese Office action for Application No. 2023-565558, dated Oct. 1, 2024, 5 pages.

* cited by examiner

REFILL STATION FOR A DISPENSER CAN WITH A REFILL LOCK FOR AN IMPERMISSIBLE ACTIVE SUBSTANCE

CROSS-REFERENCE TO RELATED APPLICATIONS

This application is a national US phase of PCT/EP2022/061901, filed May 4, 2022, which claims the benefit of the filing date of the German Patent Application No. 10 2021 114 334.9 filed 2 Jun. 2021, the disclosure of which is hereby incorporated herein by reference.

TECHNICAL FIELD

The disclosure relates to a refill station, a refill arrangement, and a method for operating a refill station.

Technological Background

Dispenser cans are known which are automatically refillable by a refill station. Such a known refill station is the REFILLO® mat station of the applicant Würth. This secure and economical system is based on the automatic refill of empty dispenser cans with an active substance and pressurized air. This enables to fill dispenser cans with active substances from large containers (German: Großgebinden) (for example canisters or barrels). For this purpose, the dispenser cans for the individual active substances are pushed on the corresponding refill station. Then, a refill of the dispenser can with the active substance and pressurized air in a pregiven ratio is performed. To eliminate a confusion of the dispenser can and an assigned active substance, the can reception is mechanically encoded, such that only the correct dispenser can can be mechanically attached on the correct can reception. Thereby, only a mechanically fitting dispenser can can be used with the assigned refill station. A confusion of active substances and dispenser cans, which may be dangerous under certain circumstances, is therefore mechanically suppressed.

SUMMARY OF THE DISCLOSURE

There may be a need to provide a refill station for refilling an active substance into a dispenser can with a high operational safety.

This need is met by the subject-matters with the features according to the independent patent claims. Further embodiments are shown in the dependent claims.

According to an embodiment of the present invention, a refill station is provided, comprising a receiving device for receiving a dispenser can which is to be refilled with an active substance, a capturing unit for capturing if an active substance which is to be refilled into the dispenser can which is received at the receiving device fulfills at least one predetermined permissibility criterion, and a control unit which is configured for permitting a refill of the dispenser can with the active substance via the receiving device only when the active substance which is captured at the capturing unit fulfills the at least one predetermined permissibility criterion.

According to another embodiment of the present invention, a refill arrangement is provided, comprising a refill station with the above-described features, and a dispenser can which is attached or attachable at the receiving device, for which, by the control unit, a refill with the active substance is only permitted, when the active substance which is captured at the capturing unit fulfills the at least one predetermined permissibility criterion.

According to yet another embodiment of the present invention, a method for operating a refill station is provided, wherein the method comprises receiving a dispenser can which is to be refilled with an active substance at a receiving device of the refill station, capturing if an active substance which is to be refilled into the dispenser can which is received at the receiving device fulfills at least one predetermined permissibility criterion, and permitting a refill of the dispenser can with the active substance via the receiving device only when the captured active substance fulfills the at least one predetermined permissibility criterion.

In the context of the present application, a "refill station" may in particular denote an apparatus which is configured for refilling a dispenser can, which is at least partially empty and mechanically and fluidically couplable with the refill station, with an active substance from an active substance container (German: Wirkstoffgebinde) to be connected. Thus, a refill station may provide a fluidic connection between a container for providing the active substance to be refilled and the dispenser can to be refilled, and may be optionally configured for providing a pressurized gas to be refilled at the dispenser can.

In the context of the present application, a "receiving device" may in particular denote a mechanical and fluidic adapter which is configured for receiving, in particular in a form-locking manner, a dispenser can to be refilled, and which, in the received state, can provide the active substance and/or pressurized gas at the dispenser can. Beyond the mechanical adapter function, the receiving device may also function as a fluidic adapter for providing a fluid connection between a container with the active substance and the dispenser can which is to be refilled with the active substance.

In the context of the present application, a "dispenser can" (German: Spenderdose) (for example configured as aerosol can) may in particular denote a can which is handable by a user, which is configured for discharging (in particular for spraying a spray mist or for discharging an active substance in form of an active substance beam, a foam, or a gel) preferably liquid active substance. This active substance is pressurized in an interior of the dispenser can, wherein pressurized gases or propellant gases in the dispenser can (for example propane, butane, compressed air, carbon dioxide, helium, or oxygen) may be used for discharging the active substance from the dispenser can. Through a nozzle, the ingredients (in particular the active substance or an active substance-propellant gas-mixture) can be sprayed, dispensed, and/or discharged in another form out of the aerosol can. In particular, a medium which is located in the aerosol can, can be sprayed out of the aerosol can as an aerosol.

In the context of the present application, an "active substance" may in particular denote a medium which, in a state sprayed out of the dispenser can, provides the actual function of the dispenser can. Such an active substance may comprise a liquid, a gel, a viscous medium, and/or a gas, optionally comprising solid particles. For example, such an active substance may be a cleaning agent (for example a brake cleaning agent), a rust remover, a maintenance oil, a silicone spray, a windows cleaning agent, a leakage detection medium, a welding spray, etc. In a refill station, such an active substance may be refilled from a container (for example a canister) into a dispenser can to be refilled.

In the context of the present application, a "control unit" may in particular denote a unit which controls the process of refilling the active substance into a dispenser can, in particular allows it in a defined manner or prevents it in an error case. In particular, such a control unit may comprise at least one processor and/or a part of a processor which evaluates a provided information about an intended and/or performed refill process and, if necessary, performs, adapts, restricts, extends, or prevents the refill process. In particular, for this purpose, the control unit may control or regulate individual components of the refill station.

In the context of the present application, a "capturing unit" may in particular denote an entity with a sensor function or a detector function which examines an active substance which shall be refilled into the dispenser can with respect to the circumstance if the active substance fulfills one or more permissibility criteria. For this purpose, for example, the active substance may be metrologically examined in a supply unit, for example a supply conduit, in a contactless and/or contact-bound manner. In more detail, by the capturing unit, at least one parameter which is characterizing the active substance can be measured as a basis for the subsequent examination if a permissibility criterion is fulfilled by the active substance or not.

In the context of the present application, a "permissibility criterion" in particular denotes a criterion which indicates if an active substance for refilling a dispenser can which is at least partially empty using a refill station is allowed to be used or not. For example, the at least one predetermined permissibility criterion may concern a permissibility or impermissibility of the active substance for the dispenser can, a permissibility or impermissibility of the active substance for the refill station, and/or a permissibility or impermissibility of an active substance origin. More generally, the permissibility criterion may relate to the active substance, in particular to the active substance in relation to the dispenser can and/or in relation to the refill station. Such a criterion may be the compatibility of an active substance which is captured and characterized by a capturing unit for filling a certain dispenser can, for example. A consideration in assessing this compatibility may be a permission (which is for example official or related to an industrial specification) or another technical suitability of a certain active substance for the refill of a certain dispenser can. For example, for inflammable active substances (which contain gasoline, for example), special security properties of a dispenser can may be required for the dispenser can being allowed to receive such active substances. A permissibility may then be if the active substance candidate which shall be refilled in a dispenser can is compatible with the technical properties of the dispenser can. Another permissibility criterion may concern if, under quality considerations, an active substance candidate which shall be refilled into a dispenser can can or can not deliver a proof of origin which is examined by a capturing unit. Active substance candidates which are unknown and therefore potentially not fulfilling quality requirements for an operational safety of a dispenser can which is filled with an active substance may therefore be considered as active substances which do not fulfill an assigned permissibility criterion. For example, only active substances which are fulfilling a certain permissibility criterion under quality considerations may be accepted for refilling a dispenser can, for which an origin from a reliable source is proved by the capturing unit.

According to an exemplary embodiment of the invention, prior to refilling an active substance into a dispenser can which is at least partially empty using a refill station, an active substance candidate which shall be refilled is subjected to an experimental examination by a capturing unit, if the active substance—for example due to its chemical composition and/or due to its origin from a certain source—fulfills one or more pregiven permissibility criteria or not. If an experimental or metrological detection and a subsequent evaluation of parameters at the active substance—for example in a supply conduit via which the active substance shall be supplied to a dispenser can to be refilled—results a compatibility of the active substance candidate with the permissibility criterion or the permissibility criteria, a refill process is performed which is triggered by a user, for example. In case of a recognized incompatibility of the active substance candidate with the at least one permissibility criterion based on the result of the property of the active substance candidate which is sensorially captured by the capturing unit, a control unit of the refill station may refuse, stop, terminate the performance of the refill of the dispenser can with this active substance candidate, and if necessary, may also prevent impermissible refill trials in the future, by a deactivation of supply conduits or the like. Thereby, a reliable compliance of an operational safe refill using a dispenser can with a certain active substance is guaranteed. Dangers for a user when handling a refill station and when using an active substance which is located in a dispenser can, as well as damages at subjects which are treated with the active substance in a dispenser can, may therefore be excluded.

In the following, additional exemplary embodiments of the refill station, the refill arrangement, and the method are described.

According to an exemplary embodiment, the capturing unit may be configured as an optical capturing unit for capturing a predetermined optical signal characteristic of the active substance to be refilled, when the active substance fulfills the at least one permissibility criterion. In such an optical capturing, ultraviolet light, visible light, and/or infrared light may be used, for example. An optical capturing of a signal characteristic of an active substance has the advantage that it leaves an active substance flow through a supply conduit completely non-influenced and thus does not entail a disturbance of a refill process.

According to an exemplary embodiment, the capturing unit may comprise a radiation source (in particular a light source, further in particular a UV-light source) for emitting electromagnetic primary radiation (in particular UV-light) for interacting with the active substance, and a radiation detector (in particular a light detector, further in particular a UV-light detector) for detecting electromagnetic secondary radiation (which may propagate from the active substance) in response to the interaction of the electromagnetic primary radiation with the active substance, wherein the control unit may be configured to determine, by the detected electromagnetic secondary radiation, if the active substance which is captured at the capturing unit fulfills the at least one predetermined permissibility criterion. For example, it may be determined, if the detected electromagnetic secondary radiation shows a predetermined optical signal characteristic whose presence may be the precondition for fulfilling the at least one permissibility criterion. In particular, the capturing unit may comprise an optical excitement source (i.e. an electromagnetic radiation source for emitting electromagnetic radiation) for exciting the active substance to be refilled which fulfills the at least one permissibility criterion, for absorbing and/or for emitting electromagnetic waves, and an optical detector which is configured for detecting the predetermined optical signal characteristic which is correlated with absorbing and/or emitting the electromagnetic waves.

The optical excitement source may be configured for irradiating the active substance with monochromatic or polychromatic electromagnetic radiation (for example with UV-wavelengths, visible wavelengths, or infrared-wavelengths). Thereby, for example, radiation of a selective wavelength range may be absorbed by the active substance. It is also possible that, due to the interaction of the electromagnetic excitement radiation with the active substance, an emission of secondary electromagnetic waves occurs. The spectral fingerprint of the active substance may be measured by a detection of the absorption characteristic and/or the emission characteristic of the active substance after an excitement with electromagnetic radiation. The measurement may be performed in reflection or in transmission. It may be preferred to capture a wavelength specific absorption of electromagnetic radiation by a fluorescence label of the active substance. A lack of such an absorption by the active substance may be used as an indicator that the active substance is not permitted for refilling a dispenser can. Thereby, an especially reliable misuse protection is provided, since permitting an active substance for refilling a dispenser can can be made depending on a positive determination of an expected absorption characteristic.

According to an exemplary embodiment, the capturing unit may be configured as a chemosensor for capturing a predetermined chemical characteristic of the active substance to be refilled, when the active substance fulfills the at least one permissibility criterion. For example, for this purpose, a precisely detectable chemical can be added to an active substance, which, when the active substance is flowing through a supply conduit, can be detected at a chemosensor which is brought in a physical contact with the active substance during said flowing.

According to an exemplary embodiment, the capturing unit may be configured as a radioactive radiation detector for capturing a certain radioactivity profile of the active substance to be refilled, when the active substance fulfills the at least one permissibility criterion. For this purpose, an active substance which origins from a reliable source and/or an active substance which is permitted for filling certain dispenser cans may be provided with a characteristic radioactive marker which can then be detected by a radioactive radiation detector at the refill station. Care must be taken that the concentration of the radioactive marker in the active substance is such low, that each health hazard for a user is excluded with the highest reliability. Due to the high detection sensitivity of radioactive radiation detectors, both this health protection and an error-robust recognition of a radioactive marker and a related characterizing of an active substance is reliably achievable.

According to a preferred embodiment, the refill station may comprise a prevention unit for preventing the refill of the dispenser can with the active substance, when the active substance does not fulfill the at least one permissibility criterion. A prevention unit may make it impossible to abusively continue a filling of the dispenser can with the impermissible active substance in case of failing the fulfillment of the at least one permissibility criterion by an examined active substance. Thereby, against a refill of a dispenser can with an impermissible active substance which is triggered by an abusively acting user, a reliable health protection of the user and a safely excluded damage of the refill station and/or the dispenser can and an object which is treated with it can be achieved. Preferably, for this purpose, the prevention unit may deactivate, in particular hardware-technically deactivate, the refill station with respect to refilling a dispenser can with impermissible active substance.

According to an exemplary embodiment, the prevention unit may be configured for preventing the refill of the dispenser can with the active substance by permanently or temporarily closing or otherwise deactivating (for example by closing a valve) a supply unit, in particular by closing a supply conduit for supplying the active substance via the receiving device to the dispenser can. Thus, the prevention unit may temporarily or permanently deactivate the supply unit, and in particular a supply conduit, and can make a transport of the active substance through this supply unit impossible. For this purpose, a lumen of the supply unit through which the active substance is transported, can be closed by the prevention unit, such that no active substance can be physically guided through this lumen anymore.

According to an exemplary embodiment, the prevention unit may be configured for closing the supply unit by physically pressing together the supply unit. For example, after capturing the active substance and after detecting by the control unit, that the active substance violates at least one required permissibility criterion, a mechanical pressure may be exerted to a supply conduit which mechanically closes its active substance-guiding lumen. For example, this may be performed by reversibly pressing together an elastically deformable supply conduit (for example made of plastic or rubber) by a corresponding actuator. Alternatively, this may also be performed by irreversibly pressing together a plastically deformable supply conduit (for example made of a soft metal) by a corresponding actuator.

According to an exemplary embodiment, the prevention unit may be configured for closing the supply unit by triggering a chemical reaction for closing, in particular for clogging, the supply unit. For example, after capturing the active substance and after a detection by the control unit that the active substance violates at least one required permissibility criterion, a curable adhesive or another suitable chemical can be introduced in a supply conduit, which cures in the supply conduit or clogs it in another way and thereby mechanically closes its active substance-guiding lumen.

According to an exemplary embodiment, the refill station may comprise a transponder reading device for reading dispenser can related data of a dispenser can-transponder which is attached at the dispenser can or is assigned to the dispenser can in another way, for example, when the dispenser can is attached to the receiving device, wherein the control unit may be configured for controlling the refill of the dispenser can with the active substance based on the read dispenser can related data. Alternatively or additionally, the refill station may comprise a transponder-reading device for reading active substance container related data of an active substance container transponder which is assigned to an active substance container for providing the active substance which is to be refilled in the dispenser can, wherein the control unit may be configured for controlling the refill of the dispenser can with the active substance from the active substance container which is assigned to the active substance container-transponder, based on the read active substance container related data. For example, said assignment of an active substance container-transponder to an active substance container may be performed by mechanically attaching the active substance container-transponder to the active substance container or to another position (for example at a housing of the refill station), at which reading the active substance container-transponder by a transponder-reading device is enabled.

According to an exemplary embodiment, the control unit may be configured for permitting the refill of the dispenser can with the active substance only when the read dispenser can related data and/or the read active substance container related data indicate a fulfillment of the at least one predetermined permissibility criterion. In particular, at least one predetermined permissibility criterion can be considered as fulfilled, when the read dispenser can related data and/or the read active substance container related data indicate a compatibility of the active substance with the dispenser can and/or the refill station. Advantageously, by comparing data of a dispenser can-transponder and/or an active substance container-transponder, the suitability of an active substance for refilling a dispenser can and/or for using in a refill station can be examined additionally and/or complementary to the use of the above-described capturing unit. In this way, on the dispenser can-transponder, an information about the characteristic of the dispenser can and/or active substances which are suitable for it, may be stored. For example, on the active substance container-transponder, an information about the active substance and/or refill stations and/or dispenser cans which are suitable for it, may be contained. By the implementation of a transponder related examination of the compatibility of an active substance with a dispenser can to be refilled and/or of a refill station which is used for this purpose, additionally to the examination by the capturing unit, an independent examination of the at least one permissibility criterion can be performed. For example, the control unit may enable filling the dispenser can with the active substance only when both the data of the capturing unit and the transponder related data indicate a fulfillment of the at least one permissibility criterion. Thereby, the misuse protection can be further improved, since even in case of a manipulation of the capturing unit or of the transponder, the respectively complementary examination mechanism still indicates a violation of a permissibility criterion.

According to an exemplary embodiment, the refill arrangement may comprise an active substance container which contains the active substance, and which is coupled or couplable with the receiving device, to provide the active substance for refilling the dispenser can. For example, such an active substance container may be a canister or a barrel, for example with a reception volume for the active substance in the range from 5 l to 100 l, in particular in the range from 5 l to 80 l.

According to an exemplary embodiment, the active substance in the active substance container may be provided with a capturable marker, in particular an optically capturable marker, further in particular with a fluorescence marker (or with a phosphorescence marker) or a DNA-marker, which is capturable by the capturing unit for confirming that the active substance fulfills the at least one predetermined permissibility criterion. Such a preferably optically capturable marker may be added to an active substance or may be adhered as a chemical label to a functionally active active substance component. It is also possible that the marker is a chemical marker which is capturable by a chemosensor, or a radioactive marker which is capturable by a radioactive detector.

According to an exemplary embodiment, the refill arrangement may comprise a gas reservoir which is configured for providing a pressurized gas and which is coupled or couplable with the receiving device, to provide the pressurized gas for refilling the dispenser can. Such a gas reservoir may be a pressure gas container or a port to a pressure gas conduit, for example. If the dispenser can is configured as a BoV (bag-on-valve)-dispenser can, in which the pressurized gas is permanently contained and does not escape when discharging the active substance from the dispenser can, a pressure gas reservoir may be dispensable for refilling the pressurized gas into a dispenser can.

DETAILED DESCRIPTION OF EXEMPLARY EMBODIMENTS

In the following, exemplary embodiments of the present invention are described in detail with reference to the following figures.

Same or similar components in different figures are provided with the same reference numbers.

Figure 1:
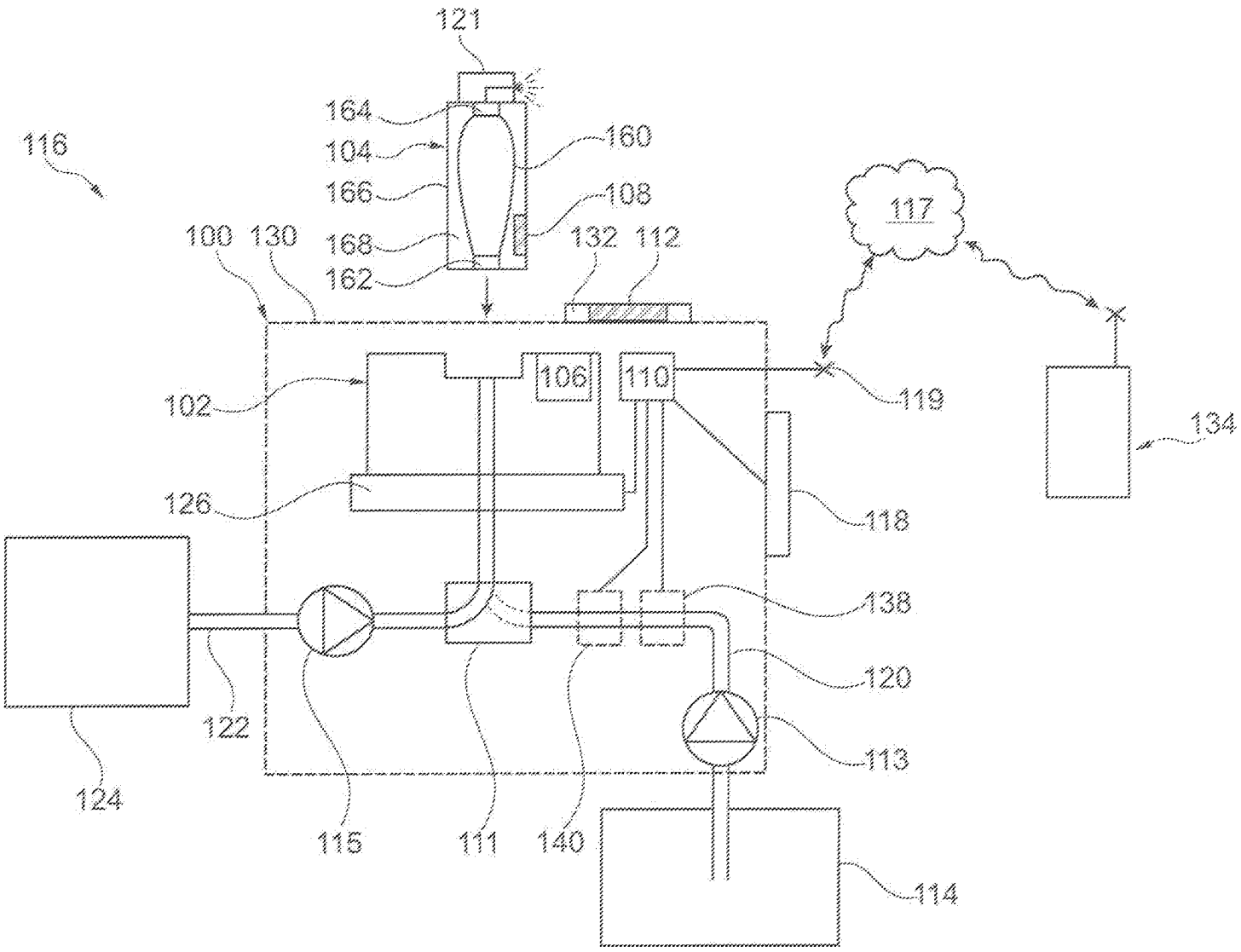
FIG. 1 shows a refill arrangement with a refill station, an active substance container, and a dispenser can, according to an exemplary embodiment of the invention.

Before, referring to the figures, exemplary embodiments of the invention are described, some general aspects of embodiments of the invention shall be explained.

According to an embodiment of the invention, a refill station is provided which uses the active substance from a container (for example a 20 l canister or a 60 l barrel), to fill or refill a dispenser can. For example, the dispenser can may be an aerosol can with a filling valve at its bottom side. Furthermore, a mechanical code can be formed at the bottom side of the dispenser can, which corresponds to a respective shape of a receiving device of the refill station. Moreover, at its top side, the dispenser can may comprise a spraying valve for discharging an active substance and/or a medium from the dispenser can.

The filling station may comprise a fluid connection to a container from which the active substance is filled in the dispenser can to be refilled. For example, such a fluid connection may be formed by a tube, to supply the active substance or the medium from the container of the refill station to a dispenser can. Preferably, such tubes are capable for an ESD-removal (ESD=electrostatic discharge). In particular, the refill station may comprise a receiving device or a placing unit for the dispenser can with a mechanical code for the purpose that only mechanically fitting encoded dispenser cans can be placed on a corresponding refill station. Furthermore, a fastener may be provided at the receiving device, to hold the dispenser can at the receiving device during its refill. Preferably, the dispenser can, regardless of its angular position to the receiving device, i.e. descriptively freely positionable around 360°, may be configured rotatable around the longitudinal axis on the coding plate (German: Kodierteller), without impeding the correct connection between the dispenser can and the receiving device. Optionally, the refill station may be equipped with a pressurized air terminal (wherein pressurized air is available in each car repair shop, for example), to fill pressurized air into the dispenser can together with the active substance. The control of the filling process may be performed by a control unit. For example, when filling a dispenser can, firstly the active substance and subsequently a pressurized medium (for example pressurized air) may be conveyed. Both may be controlled, for example pneumatically, by a three way valve. For this purpose, the refill station may be equipped with a piston with a cylinder (for example a stainless steel cylinder or a plastic cylinder), to receive the active substance and to fill a defined amount of the active substance into the dispenser can.

Advantageously, the refill station may be connected to an electrical potential equalization, since the friction of the active substance when refilling may lead to an electrostatic charging. For example, a mounting of a refill station in a shelf may be performed, wherein in the shelf at least one container (for example a canister, for example with a volume of 20 l) may be arranged. It is also possible to form a refill station with a placing part (German: Aufsatz) on an active substance barrel (for example with a volume of 60 l), or in a hazardous goods storage cupboard as a ballast adapter (German: Auflastadapter). A suitable potential equilibration may be achieved by grounding.

According to an exemplary embodiment of the invention, an especially reliable protection against an unintentional or abusive refill of a dispenser can with an active substance which is technically unsuitable for it can be implemented in a refill station. For this purpose, a sensorial capturing unit may be integrated in the refill station, which, for example by an optical sensor (for example for performing a fluorescence measurement of DNA-markers in an active substance to be refilled), a radioactivity sensor, and/or a chemosensor, detects and thereby characterizes an active substance which shall be refilled in a dispenser can. If an evaluation of the metrologically captured data for this active substance leads to the result, that the active substance does not fulfill one or more permissibility criteria, filling the dispenser can by this active substance using the refill station may be prevented. For example, this may be accomplished by a chemical clogging of a supply conduit or by a physical clamping or otherwise closing the supply conduit. Thereby, it may be prevented that a false active substance (which is technically unsuitable for a certain dispenser can or which origins from a not reliable source, for example) is filled into a dispenser can. Thereby, damages of the user, of the refill station, or of an object which is treated with the active substance from the dispenser can can be avoided.

According to an embodiment of the invention, it may therefore be reliably prevented, that a false active substance is guided through conduits of the refill station. For this purpose, for example, the flowing medium can be irradiated with UV-light, to optically recognize if it is a permissible active substance. If it is recognized that this is not the case, for example a conduit can be physically pressed together, or an adhesive can be injected into the conduit for chemically gluing it together. Thereby, for example, it can be prevented that a brake cleaner instead of a window cleaner is filled in a dispenser can to be refilled. For example, this may lead to a corrosion of O-rings or other sealings of the refill station or of the dispenser can, which may lead to a leakage or a splashing out of the brake cleaner, and consequently to a risk of inflammation.

According to a preferred embodiment, the active substance analysis which is based on the metrological examination of a permissibility criterion may be combined with a transponder-based examination of the compatibility of an active substance with a dispenser can and/or a refill station. For such a transponder-based measurement, for example a dispenser can-transponder can be attached to the dispenser can and, prior to the refill of the dispenser can with an active substance, can be read by a transponder-reading device of the refill station. Alternatively or additionally, for such a transponder-based measurement, for example an active substance container-transponder can be attached, or assigned to the active substance container in any other way, to an active substance container which is providing the active substance to be refilled, and prior to the refill of the dispenser can with the active substance from the active substance container, can be read by a transponder-reading device of the refill station. A comparison of the transponder data which are read by the transponder-reading device with the sensorially captured data for assessing the active substance by the capturing unit, may then enable an especially reliable assessment, if an active substance which shall be refilled in a dispenser can is permitted for this purpose or not.

According to an exemplary embodiment of the invention, an active substance or medium which shall be refilled into a dispenser can is marked with a marking substance. For example, for this purpose, a fluorescence agent (such as a DNA-marking) can be added to the active substance. Then, the refill station can detect if the active substance or the medium in the refill station is fluorescing (or phosphorescing). When the active substance for the medium is fluorescing (or phosphorescing), it can be concluded that it is an original medium from a reliable source of origin. In contrast, when the experimentally examined active substance is not fluorescing (or phosphorescing), it can be concluded that it is not an original medium from a reliable source of origin. In the latter case, the refill station does not fill the active substance or the medium into the dispenser can. To securely avoid a misuse, the supply conduits of the refill station for supplying the medium or the active substance can be—for example chemically or physically—closed. For example, a chemical reaction may be induced in a tube which chemically closes the tube. Therefore, an especially reliable misuse protection, for example chemically closing the conduit and/or physically closing the conduit, is possible.

FIG. 1 shows a refill arrangement 116 with a refill station 100, an active substance container 114, and a dispenser can 104 according to an exemplary embodiment of the invention. The refill arrangement 116 serves for filling or refilling a dispenser can 104, which is entirely or partially empty or emptied, with an active substance (for example brake cleaner), for the dispenser can 104 being fillable with an assigned active substance by a user in a simple manner. Then, the active substance can be sprayed out of, or more generally can be discharged out of the dispenser can 104 at a location of use. After emptying or re-emptying the dispenser can 104, the dispenser can 104 may then be filled at the refill arrangement 116 with a new active substance, etc.

For this purpose, the refill station 100 comprises a receiving device 102 which functions as a dispenser can adapter, for receiving in a form-locking and fluid coupling manner a dispenser can 104 which is to be refilled with an active substance. The receiving device 102 may be configured as a coding plate which has a mechanical interface which is shape-adapted to a corresponding mechanical interface of the dispenser can 104 to be refilled. In this way, only mechanically fitting dispenser cans 104 can be attached to the receiving device 102 which makes an erroneous operation improbable. Despite this is not illustrated in FIG. 1, at the receiving device 102, a fastener unit may be attached, by which a dispenser can 104 which is attached to the receiving device 104 can be fastened at the receiving device 102 during filling. In this way, it can be excluded that during refilling a pressure which is exerted on the dispenser can 104 or acting forces lead to an undesired release of the dispenser can 104 from the receiving device 102. After the finished refill, the fastening unit may either automatically release the dispenser can 104 or can be transferred in a state which is releasing the dispenser can 104 by a user actuation. A user may then remove the refilled dispenser can 104 from the receiving device 102 and bring it to a location of use.

Furthermore, the refill arrangement 116 may comprise the active substance container 114 which, for example as canister or barrel, may be filled with an active substance to be refilled (for example brake cleaner). Therefore, the active substance container 114 contains the active substance which is to be refilled into the dispenser can 104 and may be fluidically coupled or couplable with the receiving device 102, to provide the active substance for refilling the dispenser can 104.

If the dispenser can 104—different than in FIG. 1, see description below is not a BoV (bag-on-valve)-dispenser can with a pressurized medium which is permanently contained therein, the refill arrangement 116 may further comprise a gas reservoir 124 which is configured for providing pressurized gas and which is fluidically coupled or couplable with the receiving device 102. In this way, by the gas reservoir 124, pressurized gas (for example pressurized air) for refilling into the dispenser can 104 may be provided. For example, the gas reservoir 124 may be a terminal to a pressure gas conduit or a pressure gas bottle in which gas under overpressure is contained.

As illustrated in FIG. 1, at least one valve 111 which is configured as a three-way valve in the illustrated embodiment may form a fluid connection between the active substance container 114, the optional pressure gas reservoir 124, and the receiving device 102. As shown, the receiving device 102 may be fluidically coupled with an active substance supply unit 120 for supplying the active substance from the active substance container 114 in a dispenser can 104 which is received at the receiving device 102. Furthermore, the receiving device 102 may be fluidically coupled with an optional pressurized gas supply unit 122 for supplying the pressurized gas from the gas reservoir 124 into the dispenser can 104 which is received at the receiving device 102. For example, the at least one valve 111 may be controlled by a control unit 110, such that at first only the active substance is filled into the at least partially empty dispenser can 104, before the at least one valve 111 is switched, such that subsequently only pressurized gas from the gas reservoir 124 is filled into the dispenser can 104. Thereby, it can be ensured that a predefined amount of the active substance is filled into the dispenser can 104. Between the active substance container 114 and the receiving device 102, a conveying unit 113, for example a pump, may be arranged, for conveying the active substance from the active substance container 114 to the receiving device 102 and from there into the dispenser can 104. Optionally, also between the gas reservoir 124 and the receiving device 102, a conveying unit 115, for example a compressor or a pump, may be arranged.

FIG. 1 shows with an arrow how the dispenser can 104 is placed on the receiving device 102. In a bottom region of the dispenser can 104 in the region of its refilling valve 162, the dispenser can 104 is equipped with a dispenser can-transponder 108, for example a RFID-tag. At said bottom region, the dispenser can 104 is received at the receiving device 102. Such a dispenser can-transponder 108 which is able to communicate in a contactless manner, may be glued on the dispenser can 104 as a label, for example, or can be attached or embedded at and/or in a can housing 166. In a solid body memory of the dispenser can-transponder 108, dispenser can related data are stored which for example can identify or characterize the dispenser can 104 and an active substance which is to be filled in it, and/or may contain an information about a receiving volume of the dispenser can 104, an information about desired pressurized gas properties in the dispenser can 104, an information about a user of the dispenser can 104, etc.

In the receiving device 102, a transponder-reading device 106 for reading the dispenser can related data of the dispenser can-transponder 108 which is attached to the dispenser can 104 in a contact-free manner is arranged. The transponder-reading device 106 is arranged in a region of the receiving device 102 such that the dispenser can 104 is only located in a reading region of the transponder-reading device 106 when the dispenser can 104 is attached to the receiving device 102. Thereby, it is advantageously ensured that erroneous reading processes of dispenser cans 104 by the transponder-reading device 106 which are located in a larger environment of the transponder-reading device 106 are reliably prevented. For this purpose, the transponder technology on whose basis the transponder-reading device 106 and the dispenser can-transponder 108 communicate, may be configured as a short-range transponder technology, for example with a range of below 10 cm, in particular below 5 cm (for example as short-range RFID-technology). Thereby, the dispenser can related data of the dispenser can-transponder 108 may be selectively read by the transponder-reading device 106 only when the dispenser can 104 is attached to the receiving device 102. The read data may be supplied from the transponder-reading device 106 to a control unit 110 or may be stored in a not illustrated electronical mass storage of the refill station 100.

Preferably, also the active substance container 114 is provided or associated with an active substance storage-transponder 112 (not shown). In a solid body memory of the active substance container-transponder 112, active substance container related data are stored which are selectively readable by the transponder-reading device 106, when the active substance container-transponder 112—as shown—is attached to a housing 130 of the refill station 100. To enable or to simplify the readability of the active substance container-transponder 112 by the transponder-reading device 106, the active substance container-transponder 112 may be configured as a label 132 which is separable from the active substance container 114 in a defined manner. For example, the label 132 may be configured as an adhesive label which is equipped with the active substance container-transponder 112, which a user can separate from the active substance container 114 which is for example configured as a canister and can be glued to a position which is provided for this purpose (and which is for example correspondingly marked) at the housing 130. By attaching or adhering or alternatively providing, the active substance container-transponder 112 can be brought into the readability distance of the transponder-reading device 106, such that the active substance container related data can be read by the transponder-reading device 106. By the fact that also the active substance container-transponder 112 firstly must be transferred by a defined user activity into the readability distance of the transponder-reading device 106, before the active substance container related data can be captured by the transponder-reading device 106, a reliable protection against reading false active substance container related data is provided. For example, the active substance container related data may contain an information about the active substance in the active substance container 114, about a filling amount or residual filling amount in the active substance container 114, an information about a dispenser can 104 or the refill station 100 which is suitable for this active substance, etc.

The control unit 110 can evaluate the dispenser can related data and the active substance container related data which are provided to it by the transponder-reading device 106, and can examine them, for example with respect to their compatibility. In particular, the control unit 110 can be determined from the data which are read by the transponder-reading device 106, if the active substance which is provided by the active substance container 114 fits into the dispenser can 104 which is received at the receiving device 102. In this way, the operational safety can be increased, since it can be excluded that a dispenser can 104 which is unsuitable for a, for example dangerous, active substance (which for example comprises gasoline and is thus at the risk of fire) is used. In a corresponding manner, it can be excluded, that an active substance which origins from an unreliable source is permitted for the refill of a dispenser can 104. Even when a user manipulates the shape of a dispenser can 104, to mount it on a receiving device 102 regardless the incompatibility of an active substance container 114 which is fluidically coupled with the receiving device 102, this may be recognized by the control unit 110 by reading the dispenser can-transponder 108. Filling a dispenser can 104 which is unsuitable for a certain active substance may thus be reliably avoided by the described transponder-configuration. Thereby, a high operational safety can be achieved when using the refill arrangement 116. If the dispenser can related data and the active substance container related data show a compliance, the refill process is triggered or permitted by the control unit 110, in other cases, the refill process is prevented or not permitted.

FIG. 1 further shows that a portable user end device 134 is communicatively coupled with a software app for a user-sided control of the refill arrangement 116 by the control unit 110. The user end device 134 may be a mobile radio device which may be communicatively coupled in a wireless manner via a communication network 117 (for example a mobile phone network or the public Internet) with a communication interface 119 of the refill station 110. Thus, a user may transmit control commands to the refill arrangement 116 or monitor the operation of the refill arrangement 116 from a remote position.

Furthermore, FIG. 1 shows that the refill station 100 comprises a display unit 118 for displaying an information, such as dispenser can related data, active substance container related data, and/or another information for a user. For example, the display unit 118 may be configured as an LCD-display or a touchscreen. By the display unit 118, during and/or after a refill process, an associated information can be shown to a user at the display unit 118.

With advantage, the refill station 100 according to FIG. 1 may comprise a scale (German: Waage) 126 which is for example configured as a beam scale (German: Balkenwaage), for capturing a weight, or a weight information which is indicative for it, of the dispenser can 104 at the receiving device 102 prior to a refill process and/or during a refill process. A weight capturing of the dispenser can 104 prior to a refill process enables to qualitatively or quantitatively determine a possible residual filling of the dispenser can 104 with the active substance and/or with a pressurized gas, and to correspondingly adapt or perform a refill process which is subsequently to be performed. By considering a possible residual filling of the dispenser can 104 prior to its refill, an overfilling of the dispenser can 104 can be avoided. It is also possible to monitor the weight gain of a dispenser can 104 to be refilled during a refill process, to avoid a possible overfilling and underfilling. The control unit 110 to which the results of the weight capturing by the scale 126 can be provided, may consequently be configured to control a refill of the dispenser can 104 with the active substance based on the captured weight.

Preferably, the scale 126 may be configured for capturing a sum weight information which is indicative for a sum weight of the dispenser can 104, a residual filling of the active substance in the dispenser can 104 and a part of the refill station 100 (in particular at least a part of the receiving device 102) prior to a refill process and/or during a refill process. By the control unit 110, a refill of the dispenser can 104 with the active substance may then be controlled based on the captured sum weight information. With advantage, it may thus be dispensable to specifically capture only the weight of the dispenser can 104. It is also possible, and metrologically substantially simpler, to simply capture the mentioned sum weight, since a separation of the dispenser can 104 and the receiving device 102 during the weight determination process is then dispensable. By, prior to attaching a dispenser can 104 at the receiving device 102, capturing an empty weight of the receiving device 102 without the dispenser can 104, the residual weight which is different from the dispenser can weight of the sum weight can be mathematically subtracted, when, after attaching the dispenser can 104 to the receiving device 102, the sum weight is determined by the scale 126.

As already described, after attaching a dispenser can 104 to be refilled at the receiving device 102, by the control unit 110, a refill of the dispenser can 104 with the active substance may be permitted only when the data which are determined by the transponders 108, 112 indicate a compatibility of a dispenser can 104 which is attached to the receiving device 102 for being refilled with an active substance which is provided from a connected active substance container 114.

Alternatively or additionally, permitting a refill of a dispenser can 104 with an active substance can be made depending on the fact that an active substance which is captured at a capturing unit 138 fulfills at least one predetermined permissibility criterion. As a permissibility criterion may be used, if the active substance which is delivered in the supply unit 120 is an active substance which is permissible for the dispenser can 104, and/or if the captured active substance in the supply unit 120 fulfills an active substance origin which is considered as permissible for the dispenser can 104.

As shown in FIG. 1, by the capturing unit 138, a measurement may be performed at the active substance supply unit 120 for supplying the active substance from the active substance container 114, which measurement serves for characterizing and/or identifying the active substance which flows through the supply unit 120 which is for example configured as a tube when refilling a dispenser can 104. In this way, an active substance can be recognized which shall be used for refilling a dispenser can 104 against one or more predetermined permissibility criteria.

For example, an active substance which is permitted for refilling a dispenser can 104 may be provided with an optically recognizable marker, for example a fluorescence marker or a DNA-marker at the factory side. In this way, an active substance can be labeled which is for example permitted for refilling into a certain dispenser can 104, and/or fulfills required quality criteria. When such an active substance is conveyed through the supply unit 120, during the conveyance, by the capturing unit 138, it can be, preferably optically, recognized, if the active substance fulfills a predetermined permissibility criterion or not. For example, the permission of the filling of a dispenser can 104 with the active substance may be made depending on being able to optically capture an expected fluorescence signal by the capturing unit 138.

Data which are captured by the capturing unit 138 and which are indicative for the predetermined permissibility criterion can be supplied to the control unit 110. The control unit 110 may then allow or reject a refill of the dispenser can 104 with the active substance, namely depending on the fact, if or if not, the active substance which is captured at the capturing unit 138 fulfills the predetermined permissibility criterion. For example, an active substance may be permitted for refilling a dispenser can 104 only when a corresponding expected fluorescence marker is contained in the active substance, which for example indicates a certain active substance and/or the affiliation of the active substance to a reliable source (for example from a certain manufacturer). The examination of a predetermined permissibility criterion thus ensures a high quality of the active substance and an operational safety of the active substance in combination with the dispenser can 104.

In the illustrated embodiment, the capturing unit 138 is configured as an optical capturing unit for capturing a predetermined optical signal characteristic of the active substance to be refilled. The presence of said signal characteristic shows, that the active substance fulfills the predetermined permissibility criterion. With advantage, the capturing unit 138 may capture the active substance in the tube and/or in the supply unit 120, preferably during flowing through the supply unit 120. When the capturing unit 138 has determined the signal characteristic of the active substance candidate for refilling a dispenser can 104, this signal characteristic may be transferred to the control unit 110 for an evaluation. The control unit 110 may then, for example based on a comparison between the determined actual signal characteristic and an expected target signal characteristic, decide, if the signal characteristic indicates the fulfillment of the predetermined permissibility criterion or not. Depending on the result of this examination, the control unit 110 may then take actions to allow the refill of the dispenser can 104 with the active substance or not.

If the captured signal characteristic indicates that the active substance does not fulfill the permissibility criterion, the control unit 110 may control a prevention unit 140 for preventing the refill of the dispenser can 104 with the active substance. For example, the prevention unit 140 may press together a supply unit 120 which is configured as a flexible tube, such that no active substance can pass the supply conduit 120 anymore. Alternatively, the prevention unit 140 can introduce a curable adhesive in the supply unit 120 which is configured as a supply conduit, which chemically closes the supply conduit 120 and makes it impossible to conduct an active substance through this supply conduit 120.

The dispenser can 104 may comprise a mixture of the active substance and pressurized gas in its interior, wherein, when activating an actuation nozzle 121, an active substance-pressurized gas-mixture, for example as an aerosol, is discharged from or rinsed out of the dispenser can 104. In this case, for refilling the dispenser can 104, both new active substance and new pressurized gas is required.

Alternatively, the dispenser can 104 may be configured as a specially configured bag-on-valve dispenser can, as illustrated in FIG. 1. The refillable dispenser can 104 which is shown in FIG. 1 serves for discharging an active substance and comprises a deformable bag 164 receiving the active substance in its interior. For example, the bag 160 may be made of plastic or a metal foil. At its bottom side, the bag 160 is fluid-tightly connected with a refill valve 162. The refill valve 162 may be placed on the receiving device 102 in a liquid-tight manner and may thereby be fluidically coupled with the refill station 100, to be able to fill or refill the bag 160 with the active substance from the active substance container 114. Moreover, the bag 160 is connected at its top side with an outlet valve 164 for user-definedly spraying the active substance out of the bag 160. The actuation nozzle 121 may be placed on the outlet valve 164, to open the outlet valve 164 by activating the actuation nozzle 121, and to thereby discharge the active substance out of the bag 160 in form of a spray.

Furthermore, the dispenser can 104 according to FIG. 1 comprises a rigid can housing 166 which receives the bag 160, with respect to which the refill valve 162 and the outlet valve 164 are exposed at the bottom side and/or at a top side. In other words, the outlet valve 164 and the refill valve 162 protrude from the rigid can housing 166 at a top side and at a bottom side. For example, the can housing 166 may be a rigid metal housing. A pressurized gas may be fluid-tightly enclosed in an intermediate volume 168 between the bag 160 and the can housing 166, and can be protected against a leakage from the dispenser can 104. Therefore, it is made impossible for the pressurized gas to leak through the refill valve 162 and/or through the outlet valve 164. Thus, when the active substance is sprayed through the outlet valve 164, the active substance is not mixed with the pressurized gas, since the pressurized gas remains in the intermediate volume 168 and thus in the dispenser can 104. Thereby, also a refill of pressurized gas at the dispenser can 104 according to FIG. 1 is dispensable. Filling pressurized gas into the intermediate volume 168 may be performed at the side of the manufacturer, for example, through one of the valves 162, 164 and/or through another valve in the can housing 166 (not shown).

Figure 2:
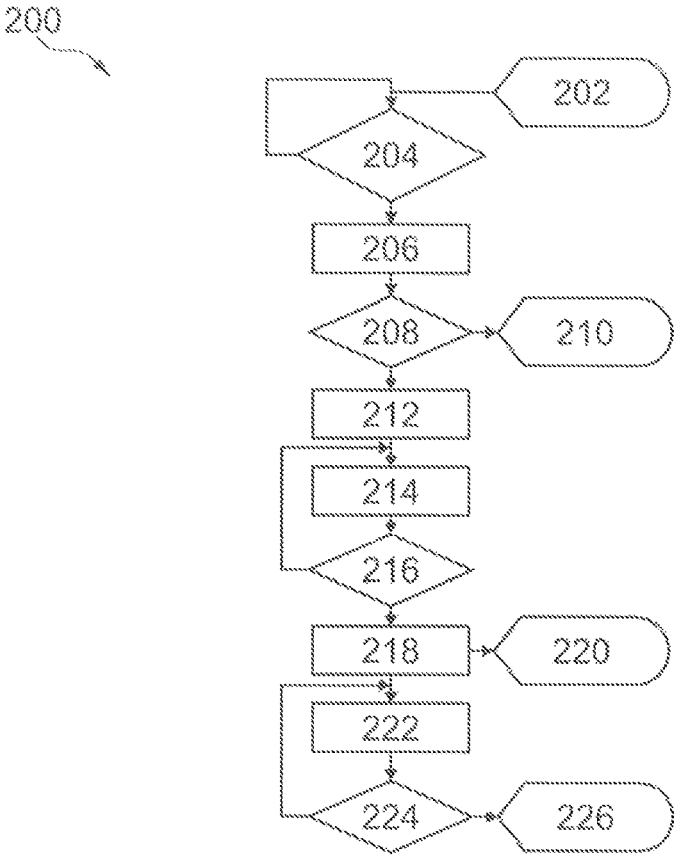
FIG. 2 shows a flow diagram which illustrates a method for operating a refill station according to an exemplary embodiment of the invention.

FIG. 2 shows a flow diagram 200 which illustrates a method for operating a refill station 100 according to an exemplary embodiment of the invention.

The method for operating a refill station 100 starts in a block 202 in which the refill station 100 indicates that it is ready for performing the method. This may be indicated at the display unit 118.

In a block 204, it is examined if a weight of a dispenser can 104 to be refilled which is captured by a scale 126 is within a predetermined range in a stable manner.

If this is the case, in a block 206, the dispenser can-transponder 108 is read by the transponder reading device 106. Furthermore, by the transponder reading device 106, an active substance container-transponder 112 can be read.

In a block 208, it is determined if an active substance and/or a medium which shall be filled into a dispenser can 104 is permissible. If this is not the case, the method concludes, that it is a false dispenser can 104, see block 210. This may be indicated at the display unit 118.

On the contrary, if this is the case, in a block 212, the residual amount of the active substance in the dispenser can 104 to be refilled is determined. Then, a pump 113 may be switched on, to deliver the active substance for a refill of the dispenser can 104 (block 214).

After refilling the dispenser can 104 with the active substance, it may be determined (for example by the scale 126) if the refilled amount of active substance in the dispenser can 104 is adequate, see block 216. If this is not the case, the method repeats the procedure according to block 214 and block 216.

On the contrary, if this is the case, the method determines in the block 218 the filling amount with the active substance and adds the entire filling amount. Corresponding to the block 220, this may be shown to a user at the display unit 118.

According to the optional block 222, the pump 115 and/or the compressor may then be switched on, to introduce pressurized gas into the dispenser can 104.

In the block 224, it is examined if the pressure in the refilled dispenser can 104 is adequate. If this is not the case, the procedures according to block 222 and block 224 are examined.

On the contrary, if this is the case, the operational method is finished, see block 226. At the display unit 118, a corresponding information may be shown. An acoustic signal (for example generated by a buzzer) may indicate the completion of the operational method.

Additionally to the described procedure of filling, it is possible, prior to filling, to detect by a pressure pulse if the dispenser can 104 is correctly placed on the receiving device 102. Furthermore, after the filling, a data transmission to a communicatively coupled node is possible. It is also possible to detect if an active substance container 114 (for example a barrel or a canister) is empty. For example, this is possible by monitoring the weight course of such an active substance container 114 when filling the dispenser cans 104.

Figure 3:
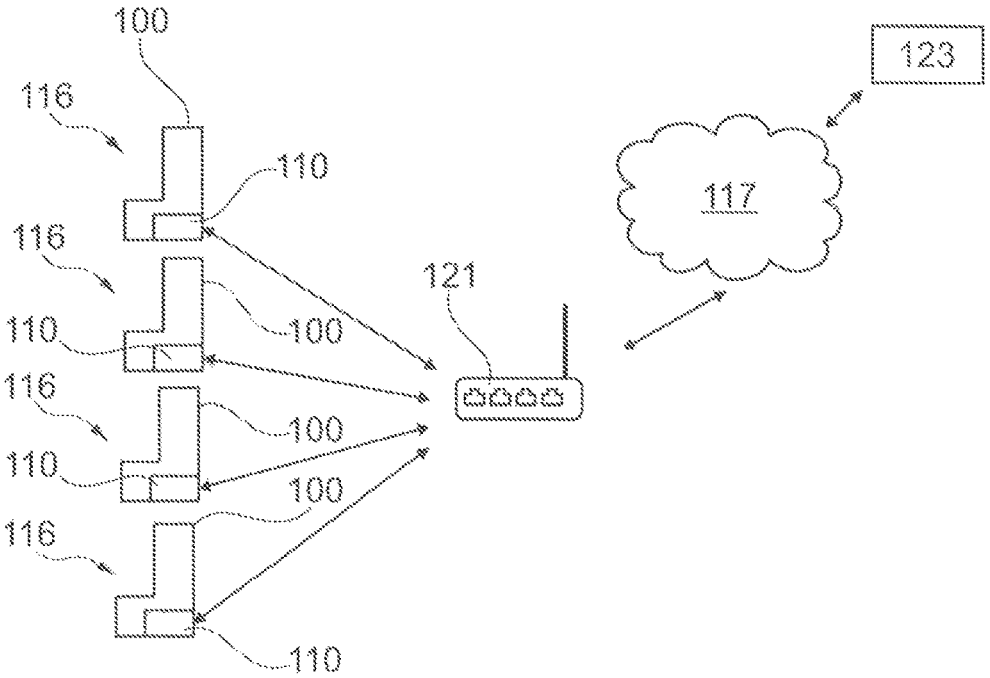
FIG. 3 shows a system with multiple refill arrangements according to an exemplary embodiment of the invention, which are communicatively coupled with a reorder device.

FIG. 3 shows a system with multiple refill arrangements 116 according to an exemplary embodiment of the invention which are communicatively coupled with a reorder unit 123.

In the system according to FIG. 3, refill arrangements 116 with the above-described features are communicatively coupled with a node 121 (for example a gateway). The node 121 in turn is coupled via a communication network 117 with a reorder unit 123. When a control unit 110 and/or a scale 126 of a refill arrangement 116 recognizes that an active substance container 114 will be empty soon (for example since a residual filling of the active substance container 114 with an active substance fell below a certain threshold value), this information may be transmitted via the node 121 and the communication network 117 of the reorder unit 123, whereby a reorder of a new active substance container 114 with the active substance is triggered.

According to FIG. 3, consumption data with respect to the active substance may be transferred, for example to a Kanban-system. The transferred data may contain an identifier of a respective refill arrangement 116, an identifier of a dispenser can 104, a date and a time, and an active substance and a consumed and/or a reordered amount of the active substance. As illustrated, a node 121 may commonly function as a gateway for multiple refill arrangements 116. Software and in particular firmware may be installed at the refill arrangements 116, the nodes 121, and/or the reorder unit 123.

Figure 4:
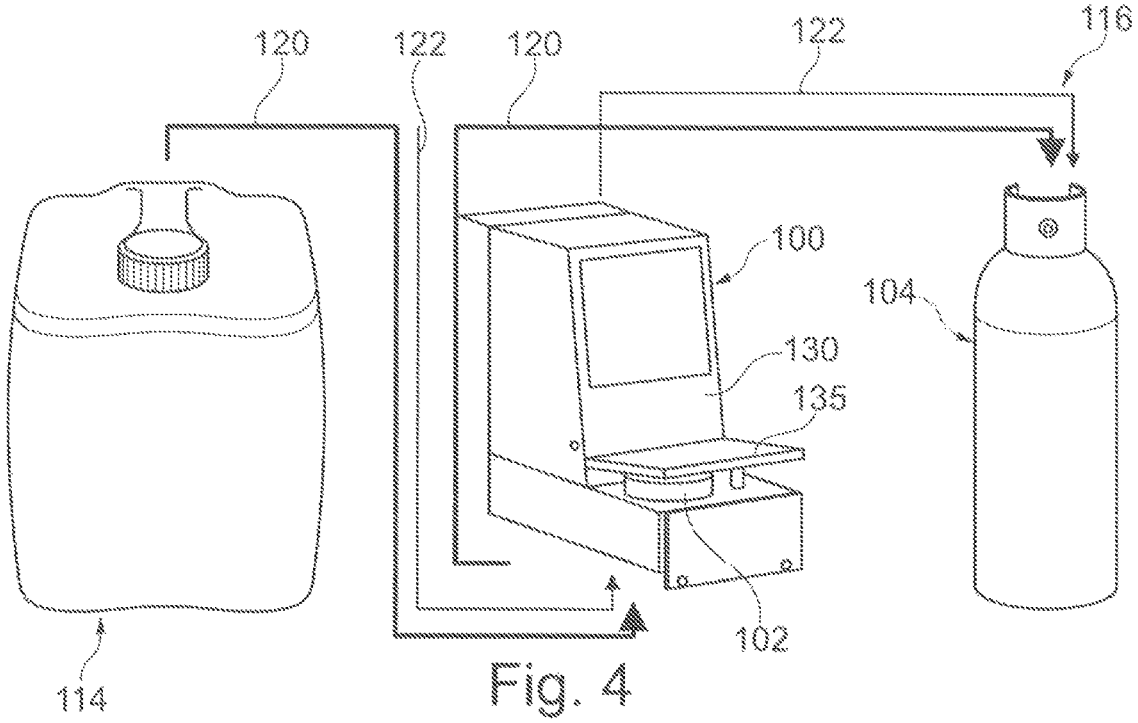
FIG. 4 shows a material flow in a refill arrangement with a refill station, an active substance container, and a dispenser can, according to an exemplary embodiment of the invention.

FIG. 4 shows a material flow in a refill arrangement 116 with a refill station 100, an active substance container 114, and a dispenser can 104, according to an exemplary embodiment of the invention.

The active substance may be transferred from the active substance container 114 via a supply unit 120 of the refill station 100 and from there to the dispenser can 104 which is mounted at a receiving device 102 after upwardly tilting a cover 135. The pressurized gas may be transferred from a pressurized gas reservoir via a supply unit 122 of the refill station 100 and from there to a dispenser can 104 which is mounted at the receiving device 102. If the dispenser can 104 is a BoV-dispenser can, refilling the pressurized gas is dispensable.

Figure 5:
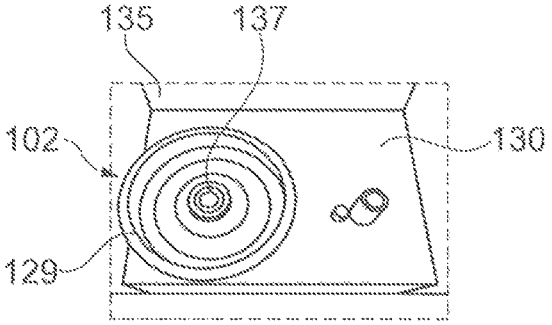
FIG. 5 shows a receiving device of a refill station according to an exemplary embodiment of the invention.

FIG. 5 shows a receiving device 102 of a refill station 100 according to an exemplary embodiment of the invention.

Figure 6:
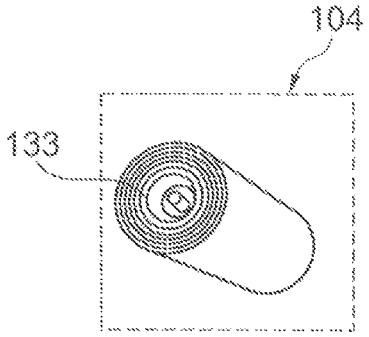
FIG. 6 shows a bottom of a dispenser can of a refill arrangement according to an exemplary embodiment of the invention.

FIG. 6 shows a bottom of a dispenser can 104 which is to be mounted at the receiving device 102 according to FIG. 5 of a refill arrangement 116 according to an exemplary embodiment of the invention.

At the receiving device 102, a coding plate 129 for receiving a bottom region 133 of the dispenser can 104 is formed. The coding plate 129 is formed mechanically complementary to the bottom region 133 of the dispenser can 104 (see FIG. 6). The coding plate 129 may be exposed by upwardly tilting a flap or a cover 135 according to FIG. 4. In a central region of the coding plate 129, a fluid terminal 137 is illustrated, which can be fluidically coupled with a refill valve 162 of the dispenser can 104, to refill the active substance and/or pressurized gas through the refill valve 162 into the dispenser can 104 through the fluid terminal 137.

After mounting the dispenser can 104 at the coding plate 129, a locking unit for locking the dispenser can 104 at the coding plate 129 may be actuated, to prevent an undesired release of the dispenser can 104 from the receiving device 102 during the refill process. After finishing the refill process, the dispenser can 104 may be unlocked and removed from the receiving device 102.

Figure 7:
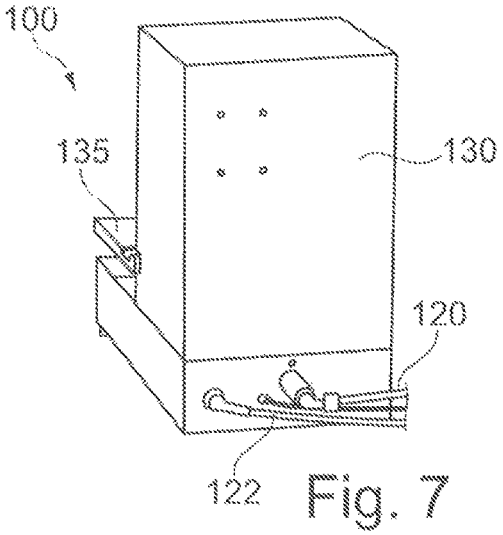
FIG. 7 shows a backside of a refill station according to an exemplary embodiment of the invention.

FIG. 7 shows a backside of a refill station 100 according to an exemplary embodiment of the invention. In particular, in FIG. 7, portions of the supply units 120, 122 are shown.

Figure 8:
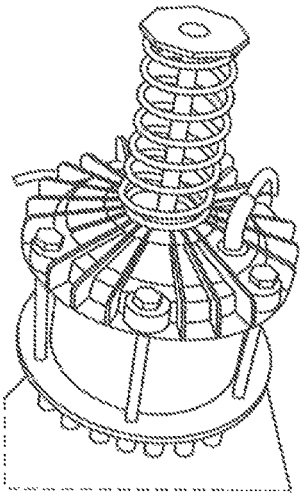
FIG. 8 shows a mechanism for refilling a dispenser can in a refill arrangement according to an exemplary embodiment of the invention.

FIG. 8 shows a mechanism for refilling a dispenser can 104 in a refill arrangement 116 according to an exemplary embodiment of the invention. Said mechanism contains a piston and a cylinder of a predetermined size, such that, by a suitable pressure, a filling amount to be dosed is definable.

Figure 9:
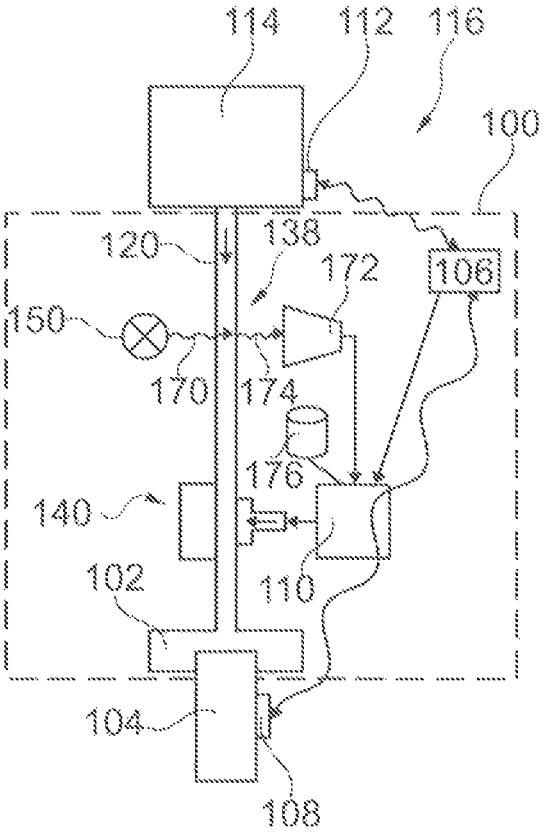
FIG. 9 shows a refill arrangement with a physical medium lock for preventing the refill of a dispenser can with an impermissible active substance according to an exemplary embodiment of the invention.

FIG. 9 shows a refill arrangement 116 with a physical medium lock for preventing the refill of a dispenser can 104 with an impermissible active substance according to an exemplary embodiment of the invention.

The illustrated refill arrangement 116 comprises a refill station 100, a dispenser can 104 which is attached to the receiving device 102, and an active substance container 114 with an active substance for refilling the dispenser can 104. A control unit 110 of the refill station 100 allows a refill of the dispenser can 104 with the active substance from the active substance container 114 via the receiving device 102 only when the active substance which is captured at the capturing unit 138 fulfills predetermined permissibility criteria.

In the illustrated embodiment, as permissibility criteria are considered that the active substance from the active substance container 114 can be considered as an active substance which is permissible and technically suitable for the dispenser can 104 and for the refill station 100, and that the active substance origins from a reliable source or origin. In the illustrated embodiment, the active substance fulfills both permissibility criteria. The active substance which shall be refilled into the dispenser can 104 according to FIG. 9, is a windows cleaner for vehicles which origins from a certified original manufacturer. In order to confirm this, the active substance is provided with a very special optically recognizable fluorescence marker at the certified manufacturer. The presence of a fluorescence marker (for example with defined properties, such as a concentration, a combination of an absorption at multiple certain UV-wavelengths, etc.) is used as a proof for the origin of the active substance from the original manufacturer and is used as an indicator for the ingredients of the active substance (in the described example a windows cleaner) in the illustrated embodiment.

In order to examine if the active substance which is provided in the active substance container 114 for refilling the dispenser can 104 fulfills the mentioned permissibility criteria, the refill station 100 according to FIG. 9 comprises the optical capturing unit 138 for capturing if the active substance which is to be refilled into the dispenser can 104 which is received at the receiving device 102 fulfills said predetermined permissibility criteria. For this purpose, the optical capturing unit 138 is configured for capturing a predetermined optical signal characteristic of the active substance to be refilled, wherein in case of a presence of said optical signal characteristic, the permissibility criteria are interpreted as fulfilled by the active substance. As illustrated in FIG. 9, the capturing unit 138 comprises a radiation source 150 for emitting electromagnetic primary radiation 170 for interacting with the active substance, and a radiation detector 172 for detecting electromagnetic secondary radiation 174 which is generated in reaction to the interaction of the electromagnetic primary radiation 170 with the active substance. The control unit 110 may be configured to determine by the detected electromagnetic secondary radiation 174 if the active substance which is captured at the capturing unit 138 fulfills the at least one predetermined permissibility criterion. In particular, the refill station 100 may comprise the optical excitement source or radiation source 150 for emitting ultraviolet light as electromagnetic primary radiation 170. This comprises for example UV-radiation in the range of an absorption band of the fluorescence marker with which fluorescence marker the active substance in the active substance container 114 is provided. Consequently, by the active substance in a supply conduit of the supply unit 120, an absorption of the electromagnetic primary radiation 170 in the range of said absorption band is performed. The optical radiation detector 172 (for example a photocell or a CCR-camera or a CMOS-camera) of the capturing unit 138 serves for detecting the electromagnetic secondary radiation 174 which is detectable after an interaction of the electromagnetic primary radiation 170 with the active substance. This detection may be performed in transmission or in reflection and may deliver the information that the active substance has absorbed electromagnetic radiation in the range of said UV-absorption band. By comparing with reference data in a database 176, the control unit 110 may recognize by the detected optical signal characteristic of the active substance, that it is a windows cleaner and origins from a certain manufacturer. The control unit 110 may further determine if the recognized windows cleaner of said manufacturer is permissible for a use with the refill station 100 and/or for a use with the dispenser can 104. Since this is the case in the present example, the control unit 110 may permit a refill of the dispenser can 104 with the active substance, since the active substance which is captured at the capturing unit 138 fulfills said permissibility criteria.

The misuse protection and/or the counterfeit security in the operation of the refill station 100 may be additionally improved by the actions which are described in the following: according to FIG. 9, the refill station 100 namely comprises a transponder-reading device 106 which is configured as a RFID-reading device for reading dispenser can related data of a dispenser can-transponder 108 (for example a RFID-tag) which is attached to the dispenser can 104. Moreover, the transponder-reading device 106 is also configured for reading active substance container related data of an active substance container-transponder 112 (for example a further RFID-tag) which is assigned to the active substance container 114 for providing the active substance which is to be refilled into the dispenser can 104. By reading the dispenser can-transponder 108 and/or the active substance container-transponder 112, an information about the active substance and the dispenser can 104 can be read. The control unit 110 may be configured for controlling the refill of the dispenser can 104 with the active substance via the receiving device 102 based on the read dispenser can related data and/or based on the read active substance container related data. Advantageously, the control unit 110 may be configured for permitting the refill of the dispenser can 104 with the active substance only when the read dispenser can related data and the read active substance container related data indicate a compatibility of the active substance with the dispenser can 104 and the refill station 100.

It is especially preferred when permitting the refill of the dispenser can 104 with the active substance from the active substance container 114 by the control unit 110 is made depending on that the capturing results of the capturing unit 138 on the one hand and the read dispenser can related data and/or the read active substance container related data on the other hand indicate the fulfillment of the at least one permissibility criterion. Thereby, an identification of an impermissible combination of an active substance on the one hand and the dispenser can 104 and/or the refill station 100 and the other hand may be successively performed, even when by an abusive manipulation, the capturing-system or the transponder-system is manipulated, since the respectively other system then still enables to recognize an impermissibility of a provided active substance.

If—in contrast to the described embodiment—the active substance is recognized as violating the at least one permissibility criterion, a prevention unit 140 may prevent the refill of the dispenser can 104 with the active substance. According to FIG. 9, the prevention unit 140 is configured for preventing the refill of the dispenser can 104 with the active substance by closing a supply conduit of the supply unit 120. In particular, according to FIG. 9, the prevention unit 140, by physically pushing together the supply unit 120, may close it, such that no active substance can be delivered through it. For this purpose, controlled by the control unit 110, an actuator of the prevention unit 140 may be controlled for pushing together the supply conduit, as shown in FIG. 9 with an arrow.

Figure 10:
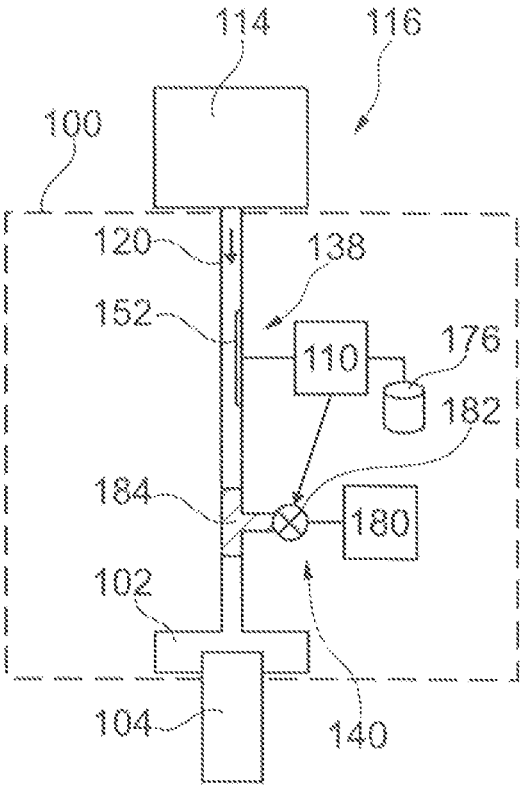
FIG. 10 shows a refill arrangement with a chemical medium lock for preventing the refill of a dispenser can with an impermissible active substance according to an exemplary embodiment of the invention.

FIG. 10 shows a refill arrangement 116 with a chemical medium lock for preventing the refill of a dispenser can 104 with an impermissible active substance according to an exemplary embodiment of the invention. The embodiment according to FIG. 10 differs from the embodiment according to FIG. 9 in particular in the configuration of the capturing unit 138 and by the configuration of the prevention unit 140:

According to FIG. 10, the capturing unit 138 comprises a chemosensor 152 for capturing a predetermined chemical property of the active substance to be refilled. To fulfill the at least one permissibility criterion, the active substance according to FIG. 10 has to be provided with a chemical which can trigger a predefined sensor event at the chemosensor 152 in the interior of the supply conduit of the supply unit 120. For determining if this is the case, the control unit 110 may compare a sensor signal of the chemosensor 152 with predetermined data sets in a database 176. In this way, the control unit 110 may determine based on the sensor data of the chemosensor 152, if the active substance is an active substance which is permitted for the dispenser can 104 and/or the refill station 100, and if it origins from a reliable source of origin. In the present embodiment, the data which are detected by the chemosensor 152 may indicate that the active substance is a brake cleaner. For this brake cleaner, it may be stored in the database 176 that it is not permitted for the dispenser can 104 which is attached to the receiving device 102, due to a danger of inflammation. Moreover, the brake cleaner may be classified as corrosive for sealings of the refill station 100 and may thus be not permitted for the refill station 100.

To protect a user against a health impairment by the impermissible active substance, and to protect the components of the refill arrangement 116 against a damage or a destruction, the control unit 110 may control a prevention unit 140 for closing the supply unit 120. According to FIG. 10, for this purpose, the control unit 110 may open a valve 182 of the prevention unit 140, such that, by a conveying unit 180 of the prevention unit 140, a curable adhesive is introduced into the supply conduit of the supply unit 120. By triggering a chemical reaction for curing the adhesive in the supply conduit, it is clogged and thereby closed. A cured adhesive plug is illustrated in FIG. 10 with the reference sign 184. A refill of the dispenser can 104 with the impermissible active substance is made impossible in an advantageous manner due to the clogged supply unit 120.

Figure 11:
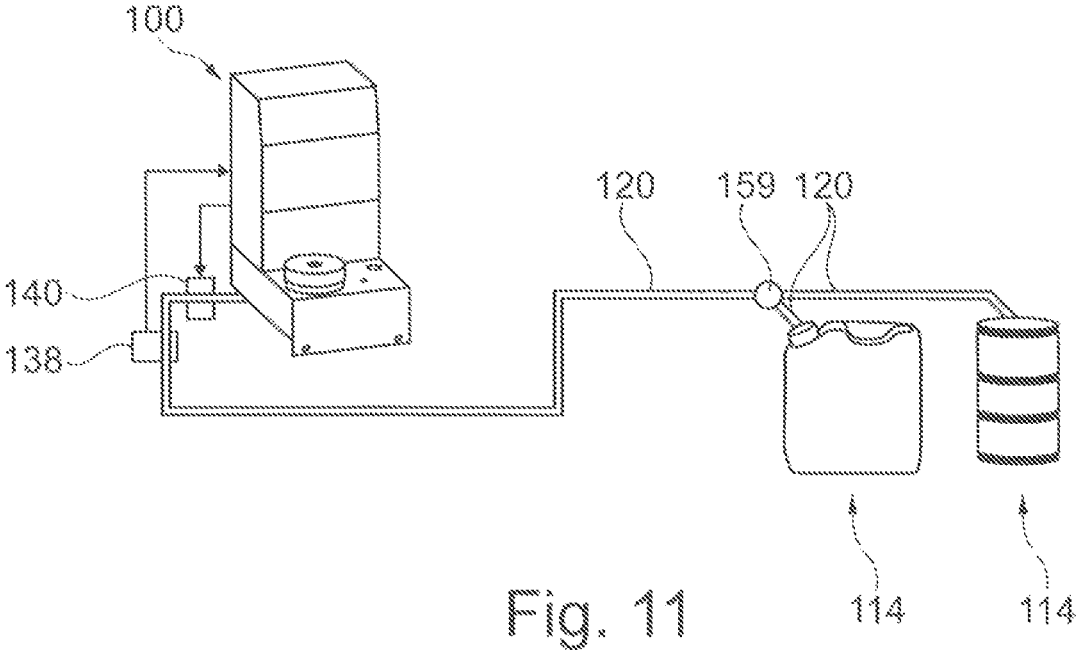
FIG. 11 shows a refill arrangement according to yet another exemplary embodiment of the invention.

FIG. 11 shows a refill arrangement 116 according to an exemplary embodiment of the invention.

The refill arrangement 116 which is illustrated in FIG. 11 has at its refill station 100 a receiving device 102 which may be configured according to FIG. 5, for example, and may be configured for receiving the dispenser can 104 which is to be refilled with an active substance. Furthermore, in the refill station 100, a control unit 110 which is for example configured as a processor for controlling the refill of the dispenser can 104 with the active substance may be contained, which may be configured according to FIG. 9 or FIG. 10, for example. The dispenser can 104 (for example configured according to FIG. 1) may be attached to the receiving device 102. Moreover, according to FIG. 10, two different active substance containers 114 with the active substance to be refilled may be fluidically coupled via a supply unit 120 with the receiving device 102, to provide the active substance for refilling the dispenser can 104. For example, a respective one of the active substance containers 114 may be selected by a fluid valve 159.

To allow the process of refilling the dispenser can 104 with an active substance from one of the active substance containers 114, by a capturing unit 138, the active substance which comes out of the respective active substance container 114 is sensorially examined, for example by optical sensorics. For example, the capturing unit 138 may determine by an optical absorption measurement, if the active substance which comes out of a respective active substance container 114 comprises an expected fluorescence label or not. An active substance which origins from a reliable source, for example an active substance which origins from a certified manufacturer, may provide the active substance with such a fluorescence label at the fabrication site. If the optical signal which is detected by the capturing unit 138 indicates to a control unit 110 of the refill station 100, that the active substance in the supply conduit of the supply unit 120 comprises this origin-indicating fluorescence label, the control unit 110 may permit the refill of the dispenser can 104 with this active substance. Otherwise, the control unit 110 may control a prevention unit 140 which is configured according to FIG. 9 or FIG. 10, for example, to prevent the refill of the dispenser can 104 with this active substance by mechanically and/or chemically blocking the supply conduit. For example, the blocking may be temporary and reversible, for example by pushing together a flexible tube of the supply unit 120 for closing a lumen of the tube, until a permissible active substance is supplied and recognized which fulfills the permissibility criterion. Alternatively, the blocking may also be permanent and irreversible, for example by making a tube of the supply unit 120 permanently ineligible for a flow of a fluidic active substance by curing an adhesive in the interior of the tube.

Supplementary it is to be noted that "comprising" does not exclude other elements or steps and "a" or "an" does not exclude a plurality. Furthermore, it is noted that features or steps which are described with reference to one of the above embodiments may also be used in combination with other features or steps of other above-described embodiments. Reference signs in the claims are not to be construed as limitation.

The invention claimed is:

1. Refill station comprising:

a receiving device for receiving a dispenser can which is to be refilled with an active substance;

an active substance container which contains the active substance and which is coupled or couplable with the receiving device, to provide the active substance for refilling the dispenser can;

a pressure gas reservoir which is configured for providing pressurized gas and which is coupled or couplable with the receiving device, to provide pressurized gas for refilling the dispenser can;

a valve which is configured as a three-way valve to form a fluid connection between the active substance container, the pressure gas reservoir, and the receiving device;

a capturing unit for capturing if an active substance which is to be refilled into the dispenser can which is received at the receiving device fulfills at least one predetermined permissibility criterion;

a control unit which is configured for permitting a refill of the dispenser can with the active substance and the pressurized gas via the receiving device only when the active substance which is captured at the capturing unit fulfills the at least one predetermined permissibility criterion; and a prevention unit for preventing a refill of the dispenser can with the active substance and the pressurized gas, when the active substance does not fulfill the at least one permissibility criterion;

wherein the at least one predetermined permissibility criterion is selected from a group which is consisting of a permissibility of the active substance for the dispenser can, a permissibility of the active substance for the refill station, and a permissibility of an origin of the active substance.

2. Refill station according to claim 1, wherein the capturing unit comprises an optical capturing unit for capturing a predetermined optical signal characteristic of the active substance to be refilled, when the active substance fulfills the at least one permissibility criterion.

3. Refill station according to claim 1, wherein the capturing unit comprises:

a radiation source for delimiting electromagnetic primary radiation for interacting with the active substance; and a radiation detector for detecting electromagnetic secondary radiation in response to the interaction of the electromagnetic primary radiation with the active substance;

wherein the control unit is configured for determining, by the detected electromagnetic secondary radiation, if the active substance which is captured at the capturing unit fulfills the at least one predetermined permissibility criterion.

4. Refill station according to claim 1, wherein the capturing unit comprises a chemosensor for capturing a predetermined chemical characteristic of the active substance to be refilled, when the active substance fulfills the at least one permissibility criterion.

5. Refill station according to claim 1, wherein the capturing unit comprises a radioactive radiation detector for capturing a predetermined radioactivity profile of the active substance to be refilled, when the active substance fulfills the at least one permissibility criterion.

6. Refill station according to claim 1, wherein the prevention unit is configured for preventing a refill of the dispenser can with the active substance by deactivating or closing a supply unit for supplying the active substance via the receiving device to the dispenser can.

7. Refill station according to claim 6, wherein the prevention unit is configured for closing the supply unit by physically pressing together the supply unit.

8. Refill station according to claim 6, wherein the prevention unit is configured for closing the supply unit by triggering a chemical reaction for closing the supply unit.

9. Refill station according to claim 1, comprising a transponder reading device for reading dispenser can related data of a dispenser can transponder which is assigned to the dispenser can;

wherein the control unit is configured for controlling the refill of the dispenser can with the active substance via the receiving device based on the read dispenser can related data.

10. Refill station according to claim 9, wherein the control unit is configured for permitting the refill of the dispenser can with the active substance only when the read dispenser can related data or the read active substance container related data indicate a fulfillment of the at least one predetermined permissibility criterion.

11. Refill station according to claim 1, comprising a transponder reading device for reading active substance container related data of the active substance container transponder which is assigned to the active substance container for providing the active substance which is to be refilled into the dispenser can; and wherein the control unit is configured for controlling the refill of the dispenser can with the active substance from the active substance container which is assigned to the active substance container transponder, based on the read active substance container related data.

12. Refill arrangement comprising:

a refill station according to claim 1; and a dispenser can which is attachable or attached to the receiving device, for which, by the control unit, a refill with the active substance is only permitted, when the active substance which is captured at the capturing unit fulfills the at least one predetermined permissibility criterion.

13. Refill arrangement according to claim 12, wherein the active substance in the active substance container is provided with a capturable marker which is capturable by the capturing unit, for confirming that the active substance fulfills the at least one predetermined permissibility criterion.

14. Method for operating a refill station, the refill station comprising a receiving device for receiving a dispenser can which is to be refilled with an active substance; an active substance container which contains the active substance and which is coupled or couplable with the receiving device, to provide the active substance for refilling the dispenser can; a pressure gas reservoir which is configured for providing pressurized gas and which is coupled or couplable with the receiving device, to provide pressurized gas for refilling the dispenser can; a valve which is configured as a three-way valve to form a fluid connection between the active substance container, the pressure gas reservoir, and the receiving device; wherein the method comprises:

receiving the dispenser can which is to be refilled with the active substance at the receiving device of the refill station;

capturing if an active substance which is to be refilled into the dispenser can which is received at the receiving device, fulfills at least one predetermined permissibility criterion;

permitting a refill of the dispenser can with the active substance and the pressurized gas via the receiving device only when the captured active substance fulfills the at least one predetermined permissibility criterion; and preventing the dispenser can from being refilled with the active substance and the pressurized gas, when the active substance does not fulfill the at least one permissibility criterion, wherein the at least one predetermined permissibility criterion is selected from a group which is consisting of a permissibility of the active substance for the dispenser can, a permissibility of the active substance for the refill station, and a permissibility of an origin of the active substance.

* * * * *